US012371993B2

(12) United States Patent
Xu et al.

(10) Patent No.: US 12,371,993 B2
(45) **Date of Patent: *Jul. 29, 2025**

(54) DEEP-SEA ORE HYDRAULIC LIFTING SYSTEM WITH DEEP-SEA SINGLE HIGH-PRESSURE SILO FEEDING DEVICE

(71) Applicants: CHINA MERCHANTS DEEPSEA RESEARCH INSTITUTE (SANYA) CO., LTD., Yazhou Sanya (CN); CHINA MERCHANTS MARINE AND OFFSHORE RESEARCH INSTITUTE CO., LTD., Shenzhen (CN)

(72) Inventors: Lixin Xu, Shenzhen (CN); Xiuzhan Zhang, Shenzhen (CN); Hejing Liu, Shenzhen (CN); Jiancheng Liu, Shenzhen (CN)

(73) Assignees: China Merchants Marine Offshore Research Institute Co., Shenzhen (CN); China Merchants Deepsea Research Institute (Sanya) Co., Shenzhen (CN)

( * ) Notice: Subject to any disclaimer, the term of this patent is extended or adjusted under 35 U.S.C. 154(b) by 657 days.

This patent is subject to a terminal disclaimer.

(21) Appl. No.: 17/613,503

(22) PCT Filed: Dec. 25, 2020

(86) PCT No.: PCT/CN2020/139420

§ 371 (c)(1),
(2) Date: Nov. 23, 2021

(87) PCT Pub. No.: WO2021/143490

PCT Pub. Date: Jul. 22, 2021

(65) Prior Publication Data

US 2022/0243591 A1 Aug. 4, 2022

(30) Foreign Application Priority Data

Jan. 17, 2020 (CN) ..... 202010051500.3

(51) Int. Cl.
*E21C 50/00* (2006.01)
*E02F 3/88* (2006.01)
*E02F 3/90* (2006.01)

(52) U.S. Cl.
CPC ..... *E21C 50/00* (2013.01); *E02F 3/90* (2013.01); *E02F 3/8833* (2013.01)

(58) Field of Classification Search
CPC ..... E02F 3/8858; E02F 3/8833; E02F 3/90; E02F 3/94; E02F 7/005; E02F 7/10; E02F 7/065; E21C 50/00
See application file for complete search history.

(56) References Cited

U.S. PATENT DOCUMENTS 9,062,434 B2 * 6/2015 Espinasse ..... E02F 3/902
2014/0041262 A1 2/2014 Espinasse et al.
(Continued)

FOREIGN PATENT DOCUMENTS

CN 1344844 A 4/2002
CN 1125215 10/2003
(Continued)

*Primary Examiner* — Thomas B Will
*Assistant Examiner* — Robert E Pezzuto
(74) *Attorney, Agent, or Firm* — Proi Intellectual Property US

(57) ABSTRACT

A deep-sea ore hydraulic lifting system with a deep-sea single high-pressure silo feeding device, comprises a water injection pump, a water injection riser, a deep-sea single high-pressure silo feeding device, a lifting riser, a dewatering device and a pipeline. The water injection pump and the dewatering device are fixed on a mining ship. The water injection pump is connected to the deep-sea single high-pressure silo feeding device through the water injection
(Continued)

riser. The deep-sea single high-pressure silo feeding device is connected to the dewatering device through the lifting riser. The water injection pump is connected to the dewatering device through the pipeline. Seawater is pumped into the water injection riser by the water injection pump, then ore is fed into a high-pressure hydraulic pipeline by the deep-sea single high-pressure silo feeding device to be mixed with the seawater, and an obtained ore and seawater mixture is lifted.

5 Claims, 2 Drawing Sheets

(56) References Cited

U.S. PATENT DOCUMENTS

| | | | | |
|---|---|---|---|---|
| 2017/0254044 | A1* | 9/2017 | Nguyen | F04B 47/06 |
| 2021/0293255 | A1* | 9/2021 | Van Rijswick | F04F 1/06 |

FOREIGN PATENT DOCUMENTS

| | | | |
|---|---|---|---|
| CN | 2729158 | | 9/2005 |
| CN | 109611097 | | 4/2019 |
| CN | 109611097 | A | 4/2019 |
| CN | 110259453 | | 9/2019 |
| CN | 111075451 | | 4/2020 |
| CN | 211666713 | | 10/2020 |
| JP | 2003269070 | A | 9/2003 |
| JP | 2011196047 | | 10/2011 |
| JP | 6557762 | | 8/2019 |

* cited by examiner

DEEP-SEA ORE HYDRAULIC LIFTING SYSTEM WITH DEEP-SEA SINGLE HIGH-PRESSURE SILO FEEDING DEVICE

TECHNICAL FIELD

The present invention relates to the technical field of deep-sea mining, in particular to a deep-sea ore hydraulic lifting system with a deep-sea single high-pressure silo feeding device.

BACKGROUND ART

The deep seabed is rich in mineral resources. Ore hydraulic lifting systems for deep-sea mining are the core technology of deep-sea mining. Deep-sea lifting pumps are commonly used to lift the ore-seawater slurry through lifting risers to mining ships. Deep-sea lifting pumps generally adopt multi-stage design. The multi-stage lifting pumps and their control systems are relatively complicated and technically difficult, with many moving parts and low overall system reliability. When in use, the high-speed flow of the ore-seawater slurry will wear the pumps and seriously affect the service life of the pumps. However, deep-sea lifting pumps are generally installed on the seabed or are suspended on risers so that they are difficult to maintain and repair, and the cost is relatively high. Moreover, in the process of ore lifting, deep-sea ore lifting pumps continuously pump seawater from the seabed, which will also affect the ecological environment of the seabed.

SUMMARY OF THE INVENTION

In order to solve the above-mentioned drawbacks, an object of the present invention is to provide a deep-sea ore hydraulic lifting system with a deep-sea single high-pressure silo feeding device with a more environmentally friendly working process, higher efficiency and higher reliability.

In order to achieve the above object, the present invention realizes a deep-sea ore hydraulic lifting system with a deep-sea single high-pressure silo feeding device through the following technical solutions, wherein it comprises a water injection pump, a water injection riser, a deep-sea single high-pressure silo feeding device, a lifting riser, a dewatering device and a pipeline, the water injection pump and the dewatering device are fixed on a mining ship, the water injection pump is connected to the deep-sea single high-pressure silo feeding device through the water injection riser, the deep-sea single high-pressure silo feeding device is connected to the dewatering device through the lifting riser, and the water injection pump is connected to the dewatering device through the pipeline.

The water injection riser and the lifting riser may be rigid pipes, flexible pipes, or hybrid risers consisting of rigid pipes and flexible pipes.

The deep-sea single high-pressure silo feeding device comprises a storage silo, a high-pressure silo and a feeding silo connected in order from top to bottom, the outlet of the feeding silo is connected to a high-pressure pipeline, one end of the high-pressure pipeline is connected to the water injection riser, and the other end of the high-pressure pipeline is connected to the lifting riser.

A filling valve is provided between the storage silo and the high-pressure silo, and a discharge valve is provided between the high-pressure silo and the feeding silo.

The high-pressure silo is connected to the high-pressure pipeline through a pressurized pipeline, and the pressurized pipeline is equipped with a booster valve. A pressure relief valve is provided on the high-pressure silo.

A feeding device is provided between the feeding silo and the high-pressure pipeline.

The feeding device is a screw feeder or an impeller feeder.

The beneficial effects of the present invention are as follows: the water injection pump on the mining ship is used to pump seawater into the water injection riser according to the pressure and flow rate required by the ore hydraulic lifting system, then ore is fed into a high-pressure hydraulic pipeline by the deep-sea single high-pressure silo feeding device to be mixed with the seawater, and then an obtained ore and seawater mixture is lifted to the mining ship on the sea surface. The dewatering device on the mining ship is used to separate the seawater from minerals. The water injection pump on the sea surface pumps the separated seawater into the water injection riser, thus forming a semi-closed loop circulation system. The present invention results in a very small amount of seawater exchange with the submarine environment so as to realize the minimum disturbance to the submarine ecological environment. The deep-sea single high-pressure silo feeding device can realize uninterrupted feeding through repeated filling and discharge operation. There are fewer moving parts, and the reliability is high. The water injection pump on the sea surface has high pumping head and large flow rate, and is easy to maintain and repair. It makes the hydraulic lifting system of the present invention more environmentally friendly and more efficient, with high pumping head, large flow rate and good reliability, and also makes it easy to maintain and repair.

where: 1. water injection pump, 2. water injection riser, 3. deep-sea single high-pressure silo feeding device, 4. lifting riser, 5. dewatering device, 6. pipeline, 7. mining ship, 8. seawater inlet connected by a high-pressure pipeline and a water injection riser, 9. ore slurry outlet connected by a high-pressure pipe and a lifting riser, 10. high-pressure pipeline, 11. storage silo, 12. high-pressure silo, 13. feeding silo, 14. feeding device, 15. pressurized pipeline, 16. filling valve, 17. discharge valve, 18. pressure relief valve, 19. booster valve, and 21. ore-seawater slurry.

DETAILED DESCRIPTION

The embodiments of the present invention are described in details in combination with the drawings.

Figure 1:
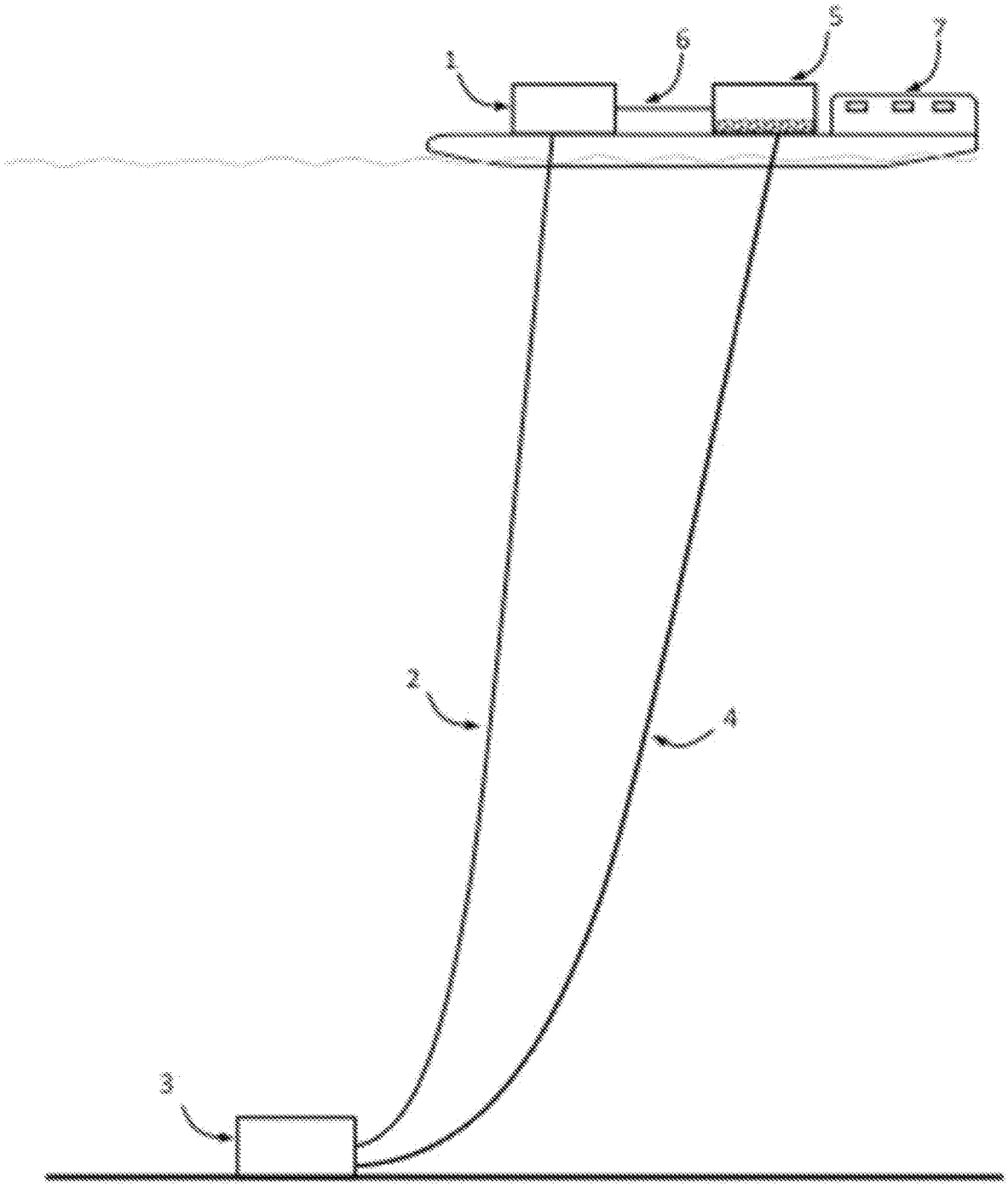
FIG. 1 is a schematic diagram of a structure of the present invention.

As shown in FIG. 1, a deep-sea ore hydraulic lifting system with a deep-sea single high-pressure silo feeding device, comprising a water injection pump 1, a water injection riser 2, a deep-sea single high-pressure silo feeding device 3, a lifting riser 4, a dewatering device 5 and a pipeline 6, wherein the water injection pump 1 and the dewatering device 5 are fixed on a mining ship 7, the water injection pump 1 is connected to the deep-sea single high-pressure silo feeding device 3 through the water injection riser 2, the deep-sea single high-pressure silo feeding device 3 is connected to the dewatering device 5 through the lifting riser 4, and the water injection pump 1 is connected to the dewatering device 5 through the pipeline 6. The water injection pump 1 on the sea surface pumps the required pressure and flow rate of seawater into the deep-sea ore hydraulic lifting system.

A semi-closed loop system is established through the water injection riser 2, the deep-sea single high-pressure silo feeding device 3, the lifting riser 4, the dewatering device 5 and the pipeline 6 so as to achieve the minimum disturbance to the submarine ecological environment. The water injection riser 2 and the lifting riser 4 may be rigid pipes, flexible pipes, or hybrid risers consisting of rigid pipes and flexible pipes.

Figure 2:
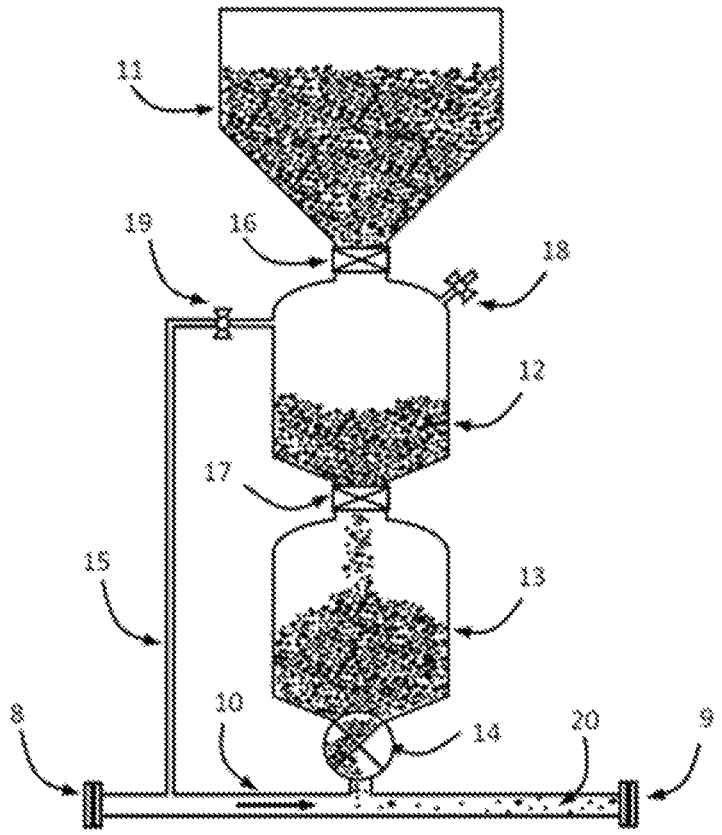
FIG. 2 is a schematic diagram of a structure of a deep-sea single high-pressure silo feeding device of the present invention.

As shown in FIG. 2, the deep-sea single high-pressure silo feeding device 3 comprises a storage silo 11, a high-pressure silo 12 and a feeding silo 13 connected in order from top to bottom, the outlet of the feeding silo 13 is connected to a high-pressure pipeline 10, one end of the high-pressure pipeline 10 is connected to the water injection riser 2, and the other end of the high-pressure pipeline 10 is connected to the lifting riser 4. A filling valve 16 is provided between the storage silo 11 and the high-pressure silo 12, and a discharge valve 17 is provided between the high-pressure silo 12 and the feeding silo 13. The high-pressure silo 12 and the high-pressure pipeline 10 are connected through a pressurized pipeline 15, and a booster valve 19 is provided on the pressurized pipeline 15. A pressure relief valve 18 is provided on the high-pressure silo 12. A feeding device 14 is provided between the feeding silo 13 and the high-pressure pipeline 10. The feeding device 14 is a screw feeder or an impeller feeder. By adjusting the feeding speed of the feeding device 14, the concentration of ore in the slurry is adjusted in real time according to the demand, so that the risk of pipeline blockage is reduced. Uninterrupted feeding is realized through the various valves on the deep-sea single high-pressure silo feeding device 3. Ore is transported from the storage silo 11 through the high-pressure silo 12 to the feeding silo 13, and the feeding device 14 transfers the ore into the high-pressure pipeline 10 according to the designated amount to be mixed with seawater, so that the ore is lifted onto the mining ship 7 through the lifting riser 4.

The working principles of the present invention are as follows: the water injection pump 1 on the mining ship 7 is turned on to pump seawater into the water injection riser 2 according to the flow rate required by the ore hydraulic lifting system, and the seawater passes through the water injection riser 2, passes through the high-pressure pipeline 10 of the deep-sea single high-pressure silo feeding device 3, returns to the lifting riser 4, reaches the dewatering device 5 on the mining ship 7 and then returns to the water injection pump 1 through the pipeline 6 so as to form a seawater circulation system.

The working process of the present invention:

Before starting, the filling valve 16, the discharge valve 17, the pressure relief valve 18 and the booster valve 19 in the deep-sea single high-pressure silo feeding device 3 are in a closed state. Then, a mining truck transports the ore to the storage silo 11.

The water injection pump 1 on the mining ship 7 is turned on to pump seawater into the water injection riser 2 according to the flow rate required by the ore hydraulic lifting system, and the seawater passes through the water injection riser 2, passes through the high-pressure pipeline 10 of the deep-sea single high-pressure silo feeding device 3, returns to the lifting riser 4, reaches the dewatering device 5 on the mining ship 7 and then returns to the water injection pump 1 through the pipeline 6 so as to form a seawater circulation system.

Then, the pressure relief valve 18 of the high-pressure silo 12 is opened. After the internal and external pressures of the high-pressure silo 12 are balanced, the filling valve 16 is opened, and the ore in the storage silo 11 falls into the high-pressure silo 12 under the gravity. When the ore in the high-pressure silo 12 reaches the set position, the filling valve 16 and the pressure relief valve 18 are in sequence closed to complete the filling operation of the high-pressure silo 12.

The booster valve 19 on the pressurized pipeline 15 between the high-pressure silo 12 and the high-pressure pipeline 10 is opened, so that the high-pressure silo 12 and the high-pressure pipeline 10 can realize pressure balance. Then the discharge valve 17 is opened, and the ore in the high-pressure silo 12 enters the feeding silo 13 under gravity.

After all the ore in the high-pressure silo 12 falls into the feeding silo 13, the discharge valve 17 and the booster valve 19 are closed in sequence to complete the discharge operation of the high-pressure silo 12.

The feeding device 14 sends the ore in the feeding silo 13 into the high-pressure pipeline 10 according to the set feeding speed to be mixed with the seawater, so as to form ore-seawater slurry 20. The ore-seawater slurry 20 is lifted to the dewatering device 5 on the mining ship 7 through the lifting riser 4 under the action of the high-pressure water flow. The dewatering device 5 separates seawater and ore. The water injection pump pumps the separated seawater into the water injection riser, thus forming a semi-closed loop circulation system to realize the recycling of seawater.

After the high-pressure silo 12 completes the discharge operation, a new round of filling operation and discharge operation is restarted with the cooperation of the valve so as to ensure that there is always a certain amount of ore in the feeding silo 13. This cycle realizes uninterrupted feeding and lifts the ore onto the mining ship.

In the whole process, there will be a very small amount of seawater exchange with the surrounding environment only during pressure relief and filling, so as to realize the minimum disturbance to the submarine ecological environment.

The water injection pump on the mining ship is used to pump seawater into the water injection riser according to the pressure and flow rate required by the ore hydraulic lifting system, then ore is fed into a high-pressure hydraulic pipeline by the deep-sea single high-pressure silo feeding device to be mixed with the seawater, and then an obtained ore and seawater mixture is lifted to the mining ship on the sea surface. The dewatering device on the mining ship is used to separate the seawater from minerals. The water injection pump on the sea surface pumps the separated seawater into the water injection riser, thus forming a semi-closed loop circulation system. The present invention results in a very small amount of seawater exchange with the submarine environment so as to realize the minimum disturbance to the submarine ecological environment. The deep-sea single high-pressure silo feeding device can realize uninterrupted feeding through repeated filling and discharge operation. There are fewer moving parts, and the reliability is high. The water injection pump on the sea surface has high pumping head and large flow rate, and is easy to maintain and repair. It makes the hydraulic lifting system of the present invention more environmentally friendly and more efficient, with high pumping head, large flow rate and good reliability, and also makes it easy to maintain and repair.

The invention claimed is:

1. A deep-sea ore hydraulic lifting system with a deep-sea single high-pressure silo feeding device, comprising a water injection pump, a water injection riser, a deep-sea single high-pressure silo feeding device, a lifting riser, a dewatering device and a pipeline, wherein the water injection pump and the dewatering device are fixed on a mining ship, the water injection pump is connected to the deep-sea single high-pressure silo feeding device through the water injection riser, the deep-sea single high-pressure silo feeding device is connected to the dewatering device through the lifting riser and the water injection pump is connected to the dewatering device through the pipeline;

wherein the deep-sea single high-pressure silo feeding device comprises a storage silo, a high-pressure silo and a feeding silo connected in order from top to bottom, the outlet of the feeding silo is connected to a high-pressure pipeline, one end of the high-pressure pipeline is connected to the water injection riser, and the other end of the high-pressure pipeline is connected to the lifting riser; and wherein the high-pressure silo is connected to the high-pressure pipeline through a pressurized pipeline, and the pressurized pipeline is equipped with a booster valve;

wherein the high-pressure silo is provided with a pressure relief valve.

2. The deep-sea ore hydraulic lifting system with a deep-sea single high-pressure silo feeding device according to claim 1, wherein the water injection riser and the lifting riser may be rigid pipes, flexible pipes, or hybrid risers consisting of rigid pipes and flexible pipes.

3. The deep-sea ore hydraulic lifting system with a deep-sea single high-pressure silo feeding device according to claim 1, wherein a filling valve is provided between the storage silo and the high-pressure silo, and a discharge valve is provided between the high-pressure silo and the feeding silo.

4. The deep-sea ore hydraulic lifting system with a deep-sea single high-pressure silo feeding device according to claim 1, wherein feeding device is provided between the feeding silo and the high-pressure pipeline.

5. The deep-sea ore hydraulic lifting system with a deep-sea single high-pressure silo feeding device according to claim 4, wherein the feeding device is a screw feeder or an impeller feeder.

* * * * *